United States Patent [19]

Block et al.

[11] Patent Number: 4,898,628

[45] Date of Patent: Feb. 6, 1990

[54] HOT WORKING METHOD FOR PRODUCING GRAIN ORIENTED SILICON STEEL WITH IMPROVED GLASS FILM FORMATION

[75] Inventors: Wayne F. Block, Waukesha, Wis.; Wade S. Wright, Fairfield, Ohio; Chris G. Klapheke, Gibsonia, Pa.

[73] Assignee: Armco Advanced Materials Corporation, Lyndora, Pa.

[21] Appl. No.: 299,714

[22] Filed: Jan. 19, 1989

[51] Int. Cl.[4] ..... H01F 1/04

[52] U.S. Cl. ..... 148/111; 148/112; 148/113

[58] Field of Search ..... 148/110, 111, 112, 113; 29/81 R, 81 D, 81 G

[56] References Cited

U.S. PATENT DOCUMENTS

| | | | |
|---|---|---|---|
| 3,393,434 | 7/1968 | Ungerer | 29/81 R |
| 4,088,513 | 5/1978 | Nakazawa et al. | 148/112 |
| 4,330,348 | 5/1982 | Nagana | 148/111 |

FOREIGN PATENT DOCUMENTS

| | | | |
|---|---|---|---|
| 93875 | 6/1983 | Japan | 148/111 |

*Primary Examiner*—L. Dewayne Rutledge
*Assistant Examiner*—George Wyszomierski
*Attorney, Agent, or Firm*—L. A. Fillnow; R. J. Bunyard; R. H. Johnson

[57] ABSTRACT

Oriented silicon steel is heated in a slab furnace at temperatures above 1260° C. prior to hot rolling. The slab surfaces in the furnace are exposed to molten slag, variable atmosphere conditions and refractory interaction from the hearth. The slab surface prior to hot rolling has a major importance for cold rolling and the quality of the glass film.

A rapid oxidation treatement of the slab just prior to the scale breaker or first rolling stand corrects a silicon-free iron layer condition which causes streaks in the glass film. The oxidation treatment blows gas having at least 30% oxygen for a sufficient time and velocity to provide a surface which will develop a continuous fayalite layer in subsequent processing and provide for the formation of a continuous glass film.

16 Claims, 3 Drawing Sheets

HOT WORKING METHOD FOR PRODUCING GRAIN ORIENTED SILICON STEEL WITH IMPROVED GLASS FILM FORMATION

BACKGROUND OF THE INVENTION

Grain oriented silicon steel having about 2 to 4.5% silicon requires careful processing to control the final grain size, orientation and coating conditions which provide good uniform magnetic properties.

The hot rolling process for oriented silicon steel requires a slab temperature which dissolves the inhibitors which later precipitate during hot rolling. As taught in U.S. Pat. No. 2,599,340, the slab temperatures are typically 1260° to 1400° C. to dissolve the grain growth inhibitors.

U.S. Pat. No. 3,764,406 recognized a difference in grain growth depending on the casting process. Continuous cast slabs have excessive grain size if processed like the ingots. A prerolling process was discovered which subjected the slab to a reduction of 5–50% at a temperature below 1250° C. to limit the grain growth during the completion of the hot rolling process. The prerolled slab was then heated to 1260° to 1400° C. to dissolve the inhibitors and prepare the slab for final hot rolling.

U.S. Pat. No. 4,330,348 recofnized some of the slab heating problems in a pusher-type furnace. The continuous cast slab had the lowest slab temperature portion (in contact with the furnace skids) carefully monitored to control secondary recrystallization.

U.S. Pat. No. 4,088,513 requires a walking-beam type furnace and properly spaced slabe to adjust for the slag conditions and improve the atmosphere circulation beneath the slab. The slag was recognized as causing yield loss and surface damage on the slab when pushed across the skids or furnace bottom.

Prior solutions to control grain size and prepare the slab for hot rolling have not addressed the internal oxidation process which results in a silicon-free iron layer with the appearance of streaks and surface scale conditions existing on the slab as it exits the furnace. Pusher-type heating furnaces have a more significant problem and causes deterioration and nonuniformity of the magnetic properties in the final strip. The streaks also cause breakage during cold rolling.

Accordingly, there remains a need for a process to eliminate the streaks which are observed after the glass film formation but are caused by the slab furnace heating conditions. Furthermore, there remains a need for a process which can be adapted to existing hot rolling equipment for silicon steel which does not require considerable equipment change or significant reduction in productivity.

SUMMARY OF THE INVENTION

According to the present invention, the grain oriented silicon steel slab while above the rolling temperature and dispersion temperature is treated with an oxygen-rich gas which will correct the silicon-free iron layer condition beneath the surface.

The surface of the oxidized slab has an improved scale condition which is easily removed by the scale breaker or high pressure water sprays at the first stand of the roughing mill. The oxidation process after the slab exits the reheat furnace also will provide improved processability and a more continuous glass-metal interface which improves the adherence of the glass coating formed during the final high temperature grain growth anneal.

A principal object of the present invention is to provide an improved surface quality of a hot rolled coil which results in improved cold rollability and glass film quality for oriented silicon steel strip. Other benefits are more uniform magnetic properties and improved physical appearance.

Another object is to correct the surface problems resulting from slab heating by using a process which is compatible with commercial operating conditions.

A still further object is to provide a solution to the problem of glass film streaks which avoids the need to rebuild or modify the slab heating furnace.

The present invention has the advantage in reducing equipment costs when comparing the replacement of hearth furnaces with walking beam furnaces. The invention also has the advantage in correcting the problem outside the furnace where the equipment is easier to install and maintain.

The above and other objects, features and advantages of this invention will become apparent upon consideration of the detailed description.

DETAILED DESCRIPTION OF THE PREFERRED EMBODIMENT

Figure 1:
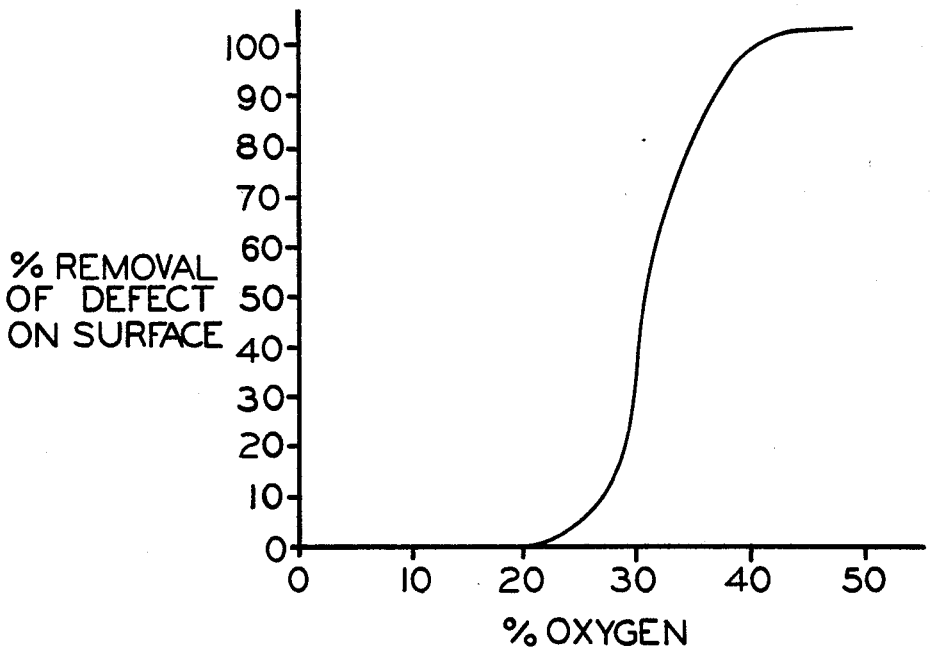
FIG. 1 is a graph showing the relationship of oxygen content in the blowing gas to the removal of the silicon-free iron layer.

Grain oriented silicon steel typically will have about 2 to 4.5% silicon. To provide the desired orientation and final grain size, additions of elements such as Mn, Al, Se, Sb, Cu or other elements are made to form nitrides, sulfides and other compounds which serve as primary grain growth inhibitors in the final high temperature anneal. The processing of the steel must be critically controlled if these compounds are to be effective inhibitors.

The production of grain oriented silicon steel strip or sheet requires that a slab obtained by continuous casting or rolled from ingots be hot rolled. Slabs are normally heated to 1260° to 1400° C. for hot rolling, although some practices have been designed to lower this temperature. In some cases, slabs may be rolled directly from the casting operation with minimal or no reheating if the equipment is in-line. The present invention is directed to a hot rolling process where the slabs are heated (or reheated) in a hearth or pusher-type furnace to a temperature above 1260° C.

The silicon steel slabs are typically about 100–300 mm in thickness, although the thickness does not represent a limitation on the invention.

The temperature required to dissolve the inhibitors present in the slab also causes the surfaces of the slab to oxidize and melt. The loss to slag not only represents a yield loss, but also creates a condition which causes quality problems, particularly on the bottom of the slab.

The bottom slab surface rests on a refractory hearth and sits in a pool of molten slag. This condition tends to seal off the slab from the atmosphere within the slab reheat furnace. The slag also accumulates within the furnace and interferes with the furance operation. The corrosive nature of the slag attacks the refractory lining of the reheat furnace and also damages the slabs and furnace equipment. The disadvantages and expense are unavoidable if the highest magnetic quality silicon steel is to be produced.

The quality problem associated with these furnace conditions is the formation of an internal silicon-free iron layer resulting from silicon depletion by internal oxidation. This layer can cause severe cold rolling problems and the formation of a discontinuous fayalite layer which results in a poor quality glass film. Micrographic studies of this defect layer commonly referred to as "silver streaks" have shown it to range from 0.5 to 1.5 mm in thickness. Several oxides may be present including FeO, $SiO_2$ and $Fe_2SiO_4$. The oxides are rpesent within the surface oxide layer and within the silicon-free iron layer beneath the surface. While silver streaks tend to form most frequently on the slab bottom, they are also found on the top surface when there is a sufficient slag buildup such as found in surface cracks.

While the variables causing the silver streak defects have been studied, the solutions to the problem have not been successful in conventional hearth or pusher-type slab furnaces. The present invention accepts the fact that the defects are extremely difficult to prevent in the reheat furnace and provides a means to remove the silicon-free internal iron layer outside the furnace and prior to hot rolling.

By subjecting the hot slab (1260°-1400° C.) to an oxygen enriched gas (greater than 30% oxygen), the silicon-free iron layer can be oxidized. The oxidized layer is easily removed by high pressure water sprays and scale breakers which are already part of the hot mill equipment. In order to provide a commercial practice with short exposure time available for oxidizing the slabs prior to hot rolling, the oxidizing gas will preferably have at least 50% oxygen. The maximum benefits for short treatment times were obtained with a gas having about 60 to 70% oxygen. At levels of oxygen higher than 70%, there was no further reduction in silver streaks using an exposure time of about one second. To avoid surface oxide problems on the hot slab, the oxygen should be kept below 90% in the blowing gas. Pure oxygen as the blowing gas caused numerous oxides to be interspersed in the molten surface which contributed to surface problems.

Referring to FIG. 1, the percentage of oxygen in the blowing gas required to provide a significant reduction in silver streaks is much more than the 20% found in air. While 30% oxygen offers a substantial improvement over air, the preferred minimum would be 40% oxygen in the blowing gas. The results are for the oxidizing conditions of 550 meters/minute gas velocity and 2 second exposure. Blowing with air left a continuous defect but with reduced thickness.

Figure 2:
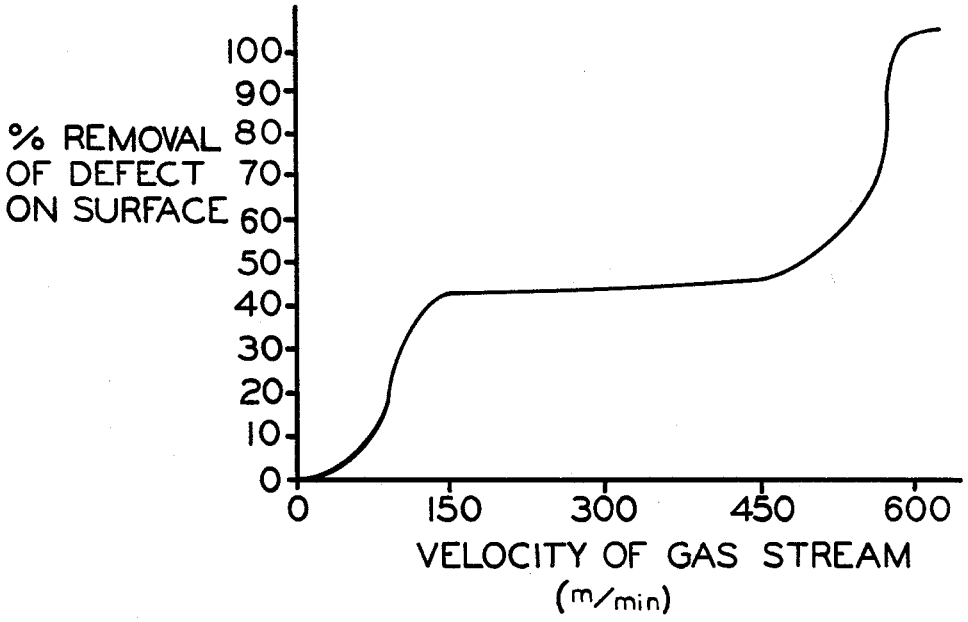
FIG. 2 is a graph showing the relationship of gas velocity to the removal of the silicon-free iron layer.

FIG. 2 clearly shows a gas velocity of greater than 1500 feet/minute (460 meters/minute) is required to significantly reduce the amount of silver streaks. Preferably a velocity above 1800 fee/minute (550 meters/minute) is used for improved removal of the silicon-free iron layer. The blowing conditions used included a time of 2 seconds and an oxygen content of 40%. It is believed that velocity influences the removel of molten slag and creates a higher oxygen gradient available for oxidizing the silicon-free iron layer.

Figure 3:
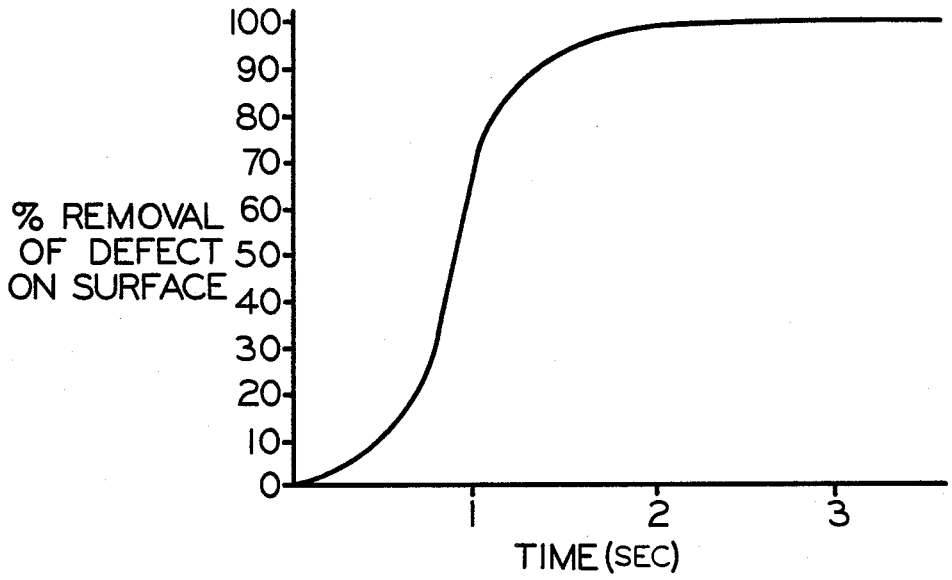
FIG. 3 is a graph showing the relationship of gas treatment time to the removal of the silicon-free iron layer.

FIG. 3 illustrates the further reduction in silver streaks with longer oxidizing gas blowing times. However, longer times mean additional equipment for the blower system or rocking of the slab which increases production time. The conditions for FIG. 3 include the use of 40% oxygen and a velocity of 550 meters/minute.

The 3 variables studied —percentage of oxygen, velocity of blowing gas, and oxidizing times —are all important to the removal of the defect. To provide a preferred system with good commercial capabilities, the blowing gas should be at least 30% oxygen, for a treatment time of at least about 1 second and at a gas velocity exceeding 550 meters/minute. The optimum balance for each hot strip mill will depend on slab heating furnace conditions, the gas nozzles used, safety considerations, and the number of passes for slab exposure available within the commercial restraints and temperature controls for defect removal and hot rolling requirements.

Figure 4:
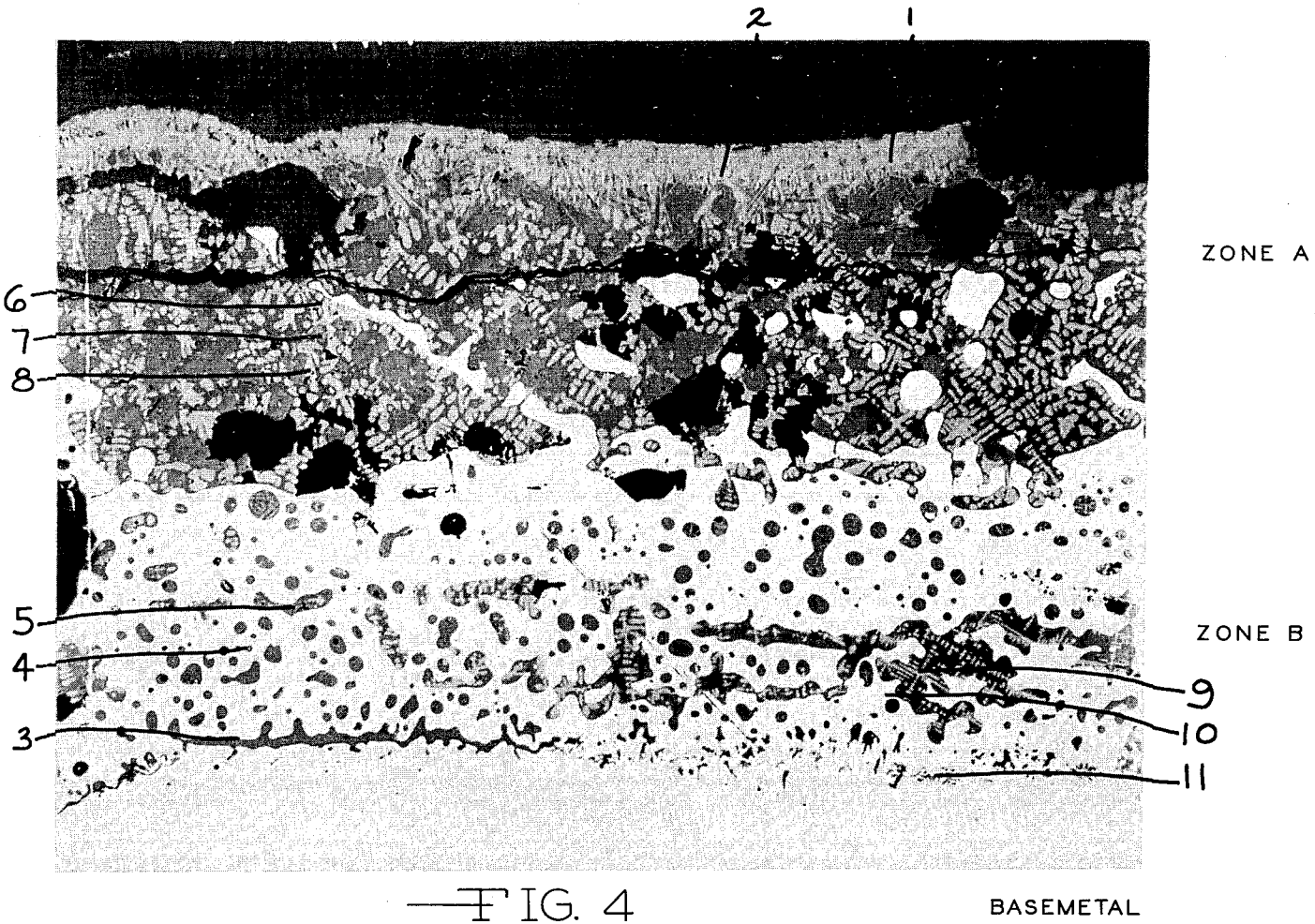
FIG. 4 is a micrograph of the surface conditions of grain oriented silicon steel prior to hot rolling when not treated by the oxidizing step of the present invention.

FIG. 4 shows the nature of the internal layer of silicon-free iron and the number of oxide phases present. The silicon-free iron layer is identified by Zone B and the surface oxide region by Zone A.

FeO (Wustite) is the light grey phase and is in greater abundance closer to the surface. There was no evidence of FeO at the oxide-base metal interface. FeO is marked in FIG. 4 by the numbers 1, 2, 5, 6 and 9. FeO is found in the silicon-free iron layer and the surface oxide region.

$SiO_2$ (Silica) is represented by the small black precipitates (11) at the oxide-base metal interface. $SiO_2$ particles were not observed anywhere but at the interface.

$Fe_2SiO_4$ (Fayalite) is shown as the darker grey phases (3, 4, 8 and 10) and was present throughout the structure.

The medium grey phase (7) is an oxide rich in aluminum and chromium. This oxide is the result of the aggressive slag attack on a high alumina brick which had a chromium oxide mortar coating.

The location gradients for the oxides shown in FIG. 4 support the inventors' belief that the silicon-free iron layer forms by an internal oxidation mechanism. While not wishing to be bound by theory, it is believed that during the heating of the slab, iron oxide and silicon oxide form at the surface. At about 1200° C. iron-silicon-oxides begin to melt. At about 1370° C. the iron oxides melt. At the normal soak temperature of 1400° C., a molten slag pool of iron and silicon oxides exist with some refractory oxides present also. The slag pool is most severe at the bottom of the slab and the slab surface is basically isolated from the furnace atmosphere by the slag buildup at the slab edges.

The environment within the slag pool is conducive to oxygen diffusion into the base metal. Since silicon is the more active element in the matrix, it reacts first to form silica. Further oxygen diffusion caused the iron at the silica to react near the silica-steel interface to form fayalite ($Fe_2SiO_4$). At 1400° C., the fayalite melts immediately. Further oxygen penetration increased the FeO content in the molten fayalite pools. During cooling, the FeO formed dendrites within the pools, which confirms the reactions occurring at soak conditions. The oxygen gradient extended further into the steel with similar reactions taking place. The thickness of the silicon-free iron layer grew parabolically with time.

The influence of oxygen content within the furnace was studied and found to have very little influence on the silicon-free iron layer. Lower levels of oxygen did decrease the amount of slag but the bottom surface of the slab was always in contact with molten slag.

Silicon-free iron formation does depend on the steel surface being in contact with the slag pool under isolated atmosphere conditions.

The process of oxidizing the slab after it exits the furnace and prior to the first stage of hot rolling has significantly reduced or eliminated the streaks formed in the subsequent insulative coating or glass film. If the blowing gas is richer in oxygen than air, blown at a rate greater than 460 meters/minute for a time of at least about one second, the silicon-free iron layer is removable by high pressure sprays prior to hot rolling. The conditions of the treatment are directed to good productivity. Obviously the benefits could be obtained with less oxygen and pressure if longer times are used.

The oxidizing treatment of the present invention produces a surface oxide or scale which is more easily removed. Apparently the silicon-free iron layer interface is a stronger bond with the base metal which caused some people to believe the streaks were rolled in scale. The oxidizing treatment penetrates below the silicon-free iron, oxidizing the iron to produce a scale layer which can be easily removed by high pressure water sprays.

The benefits of this treatment are seen in subsequent annealing, cold rolling, and decarburization operations. Removal of the silicon-free iron layer reduces breakage during cold rolling which significantly improves physical yield. During decarburization the strip surface is oxidized with a controlled atmosphere and the silicon on the surface forms a fayalite oxide. The steel is then coated with a magnesia coating and given a high temperature final anneal. The MgO reacts with the fayalite and forms a glassy insulating film during this anneal and excess MgO acts as an annealing separator to prevent sticking between the sheets.

The formation of the glassy film depends on the fayalite layer being uniform and continuous. In the past, sporadic occurrences of the silicon-free iron layer remaining on the surface of the strip prevented the formation of the required fayalite due to the lack of silicon at the surface. This caused shiny streaks on the strip surface with poor glass formation.

The present invention does not prevent the formation of silicon-free iron layer but rather it removes it along with the scale prior to hot rolling.

Grain oriented silicon steel slabs were exposed to oxygen enriched air after exiting the slab heating furance. The slabs were approximately 38 inches (0.96 m) wide and 6 inches (0.15 m) thick. The table rolls between the exit from the slab heating furnace and the scale breaker were 14 inches (0.36 m) in diameter and spaced 24 inches )0.60 m) from center to center. This allowed 10 inches (0.25 m) between rolls to provide sprays. A series of headers were connected to a large volume compressor to increase the flow of oxygen enriched gas. Slab temperature was approximately 2550° F. (1400° C.). The gas nozzles had openings of 0.094 inches (23.9 mm) in diameter. Using air enriched with 67% oxygen and exposing the bottom slab surface for one second resulted in 90% of the glass coated material having none or very light silver streaks. Without slab oxidation prior to hot rolling, the grain oriented silicon steel had only 40% with a none or very light silver streak rating.

It will be understood that various nozzles or sprays may be used to blow the oxygen enriched gas. The only requirements for the equipment is that they provide a high velocity gas which covers the slab surface completely for at least about one second of continuous exposure. While the bottom of the slab is the main surface area requiring treatment, any portion may be treated.

Various modifications may be made to the invention described without departing from the spirit and scope. The limits of the invention should be determined from the appended claims only.

What is claimed is:

1. A method of producing hot rolled grain oriented silicon steel comprising the steps of heating a slab of silicon steel to a temperature of 1260° to 1400° C. in a hearth furnace, blowing an oxygen enriched gas of at least 30% oxygen at a velocity of at least 460 meters/minute for at least about one second on said slab after exiting said slab heating furnace, removing the surface oxides from said slab, and hot rolling said slab.

2. The method of claim 1 wherein the oxygen enriched gas is at least 40% oxygen.

3. The method of claim 1 wherein the oxygen enriched gas is at least 50% oxygen.

4. The method of claim 1 wherein the oxygen enriched gas is blown at a velocity of at least 550 meters/minute.

5. The method of claim 1 wherein the oxygen enriched gas is blown from about one to three seconds.

6. A method of removing the internal layer of silicon-free iron developed in the slab heating of oriented silicon steel in a hearth furnace, including subjecting said slab to an oxidizing treatment with a gas having at least 30% oxygen at a velocity of at least 460 meters/minute after exiting said furnace and prior to a first stage of hot rolling.

7. The method of claim 6 wherein a scale breaker is used after said oxidizing treatment and prior to said first stage of hot rolling.

8. The method of claim 6 wherein said oxidizing treatment includes a gas having at least 40% oxygen at a velocity of at least 550 meters/minute and for a duration of about one to three seconds.

9. The method of claim 8 wherein said oxidizing treatment includes a gas having at least 50% oxygen.

10. The method of claim 6 wherein said slab is rocked over said oxidizing gas to provide a treatment time of about one to three seconds.

11. A method of improving the surface of cold rolled oriented silicon steel for improved adherence of an insulative coating comprising the steps of:

(a) heating a slab of oriented silicon steel in a hearth furnace to a temperature of 1260° to 1400° C., (b) subjecting said slab to an oxidizing treatment after exiting said furnace with a gas having at least 30% oxygen and a velocity of at least 460 meters/minute for at least one second, (c) removing the scale formed during said oxidizing treatment, (d) hot rolling said slab to form a hot rolled strip, (e) annealing said hot rolled strip, (f) cold rolling in one or more stages said annealed strip, (g) decarburizing said cold rolled strip and providing a continuous surface of fayalite, (h) applying an annealing separator and (i) providing a final high temperature anneal to develop the magnetic properties of the oriented silicon steel and form a continuous glassy coating.

12. The method of claim 11 wherein said oxidizing treatment includes blowing a gas having at least 40% oxygen at a velocity of at least 460 meters/minute for about one to three seconds.

13. The method of claim 11 wherein said oxidizing treatment includes blowing a gas having at least 50% oxygen.

14. A method for producing a hot rolled strip of oriented silicon steel containing 2 to 4.5% silicon having improved surface conditions for cold rolling and glass film formation, said hot rolling method comprising:

(a) providing an oriented silicon steel slab at a temperature sufficient to dissolve a secondary dispersion phase but below a temperature at which excessive grain growth occurs;

(b) oxidizing at least one of said slab surfaces with an atmosphere having at least 30% oxygen after said slab has exited a slab heating furance and prior to hot rolling;

(c) removing the scale formed by said oxidizing atmosphere; and (d) hot rolling said slab into strip.

15. The method of claim 14 wherein said oxidizing atmosphere has at least 40% oxygen.

16. The method of claim 14 wherein said oxidizing atmosphere has at least 50% oxygen.

* * * * *